US008770159B2

(12) United States Patent
Takayanagi

(10) Patent No.: US 8,770,159 B2
(45) Date of Patent: Jul. 8, 2014

(54) STRATIFIED SCAVENGING TWO-STROKE ENGINE

(75) Inventor: Yoshiaki Takayanagi, Anjo (JP)

(73) Assignee: Makita Corporation, Anjo-Shi (JP)

( * ) Notice: Subject to any disclaimer, the term of this patent is extended or adjusted under 35 U.S.C. 154(b) by 265 days.

(21) Appl. No.: 13/062,138

(22) PCT Filed: Sep. 17, 2009

(86) PCT No.: PCT/JP2009/066250

§ 371 (c)(1),
(2), (4) Date: Mar. 3, 2011

(87) PCT Pub. No.: WO2010/035684

PCT Pub. Date: Apr. 1, 2010

(65) Prior Publication Data

US 2011/0162630 A1 Jul. 7, 2011

(30) Foreign Application Priority Data

Sep. 24, 2008 (JP) ..... 2008-243805

(51) Int. Cl.
*F02B 25/00* (2006.01)
*F02B 29/06* (2006.01)

(52) U.S. Cl.
USPC ..... 123/73 AV; 123/73 A; 123/73 C; 123/76; 123/65 V; 123/73 AA

(58) Field of Classification Search
CPC ..... F02B 25/20; F02B 33/446
USPC ..... 123/73 A, 73 AV, 73 R
See application file for complete search history.

(56) References Cited

U.S. PATENT DOCUMENTS 3,815,558 A * 6/1974 Tenney ..... 123/73 A
4,066,050 A * 1/1978 Ford-Dunn ..... 123/73 SP
4,075,985 A * 2/1978 Iwai ..... 123/73 A (Continued)

FOREIGN PATENT DOCUMENTS

AU A-15166/97 9/1997
CN 1752423 A 3/2006

(Continued)

OTHER PUBLICATIONS

Written Opinion of the International Searching Authority issued in Application No. PCT/JP2009/066250; Dated Nov. 10, 2009.

(Continued)

*Primary Examiner* — Lindsay Low
*Assistant Examiner* — Kevin Lathers
(74) *Attorney, Agent, or Firm* — Oliff PLC

(57) ABSTRACT

A two-stroke engine is provided with a piston, a cylinder that houses the piston in a manner allowing reciprocation, a crankshaft that is connected to the piston via a connecting rod, a crankcase that houses the crankshaft in a manner allowing rotation, a mixture gas passage that introduces mixture gas into the crankcase, a scavenging passage that extends between a scavenging intake that opens into the crankcase and a scavenging port that opens into the cylinder; and an air passage that is connected to an intermediate position of the scavenging passage for introducing air into the scavenging passage. The engine is adapted such that, in a part of an upward stroke period of the piston, the crankcase in which negative pressure is generated is connected to the scavenging passage via the scavenging port.

18 Claims, 7 Drawing Sheets

(56) References Cited

U.S. PATENT DOCUMENTS

| | | | | |
|---|---|---|---|---|
| 4,242,993 | A * | 1/1981 | Onishi | 123/59.7 |
| 4,541,371 | A * | 9/1985 | Kageyama et al. | 123/65 PE |
| 4,577,597 | A | 3/1986 | Tomita | |
| 5,599,253 | A * | 2/1997 | Ishibashi et al. | 477/111 |
| 6,216,650 | B1 | 4/2001 | Noguchi | |
| 6,240,886 | B1 | 6/2001 | Noguchi | |
| 6,257,179 | B1 | 7/2001 | Uenoyama et al. | |
| 6,289,856 | B1 | 9/2001 | Noguchi | |
| 6,298,811 | B1 | 10/2001 | Sawada et al. | |
| 6,415,750 | B2 | 7/2002 | Rosskamp et al. | |
| 6,450,135 | B1 * | 9/2002 | Araki | 123/73 B |
| 6,668,770 | B2 | 12/2003 | Carlsson et al. | |
| 6,712,029 | B1 | 3/2004 | Andersson et al. | |
| 6,817,323 | B2 | 11/2004 | Notaras et al. | |
| 7,025,021 | B1 | 4/2006 | Andersson et al. | |
| 7,082,910 | B2 | 8/2006 | Carlsson et al. | |
| 7,536,982 | B2 * | 5/2009 | Yuasa et al. | 123/73 PP |
| 7,565,886 | B2 | 7/2009 | Carlsson et al. | |
| 7,574,984 | B2 | 8/2009 | Andersson et al. | |
| 8,181,611 | B2 * | 5/2012 | Ishida | 123/73 R |
| 2001/0011531 | A1 | 8/2001 | Uenoyama et al. | |
| 2001/0020454 | A1 | 9/2001 | Kobayashi | |
| 2002/0139327 | A1 | 10/2002 | Uenoyama et al. | |
| 2003/0106509 | A1 | 6/2003 | Uenoyama et al. | |
| 2004/0025817 | A1 | 2/2004 | Uenoyama et al. | |
| 2005/0139179 | A1 | 6/2005 | Mavinahally et al. | |
| 2007/0028868 | A1 | 2/2007 | Tsutsui | |
| 2007/0125325 | A1 | 6/2007 | Uenoyama et al. | |
| 2010/0012106 | A1 | 1/2010 | Ishida | |

FOREIGN PATENT DOCUMENTS

| | | | | |
|---|---|---|---|---|
| EP | 0 065 315 | A2 | 11/1982 | |
| EP | 0 207 446 | B1 | 6/1989 | |
| EP | 0 337 768 | A2 | 10/1989 | |
| EP | 0 764 774 | A2 | 3/1997 | |
| EP | 2 017 446 | A1 | 1/2009 | |
| FR | 2 508 103 | A1 | 12/1982 | |
| GB | 2 290 349 | A | 12/1995 | |
| JP | Y2-55-004518 | | 2/1980 | |
| JP | A-S57-188756 | | 11/1982 | |
| JP | U-S58-193015 | | 12/1983 | |
| JP | U-H3-54239 | | 5/1991 | |
| JP | A-H5-033657 | | 2/1993 | |
| JP | A-09-242546 | | 9/1997 | |
| JP | A-10-121975 | | 5/1998 | |
| JP | A-11-107761 | | 4/1999 | |
| JP | B2-3024072 | | 3/2000 | |
| JP | A-2000-186559 | | 7/2000 | |
| JP | A-2001-254624 | | 9/2001 | |
| JP | A-2001-263072 | | 9/2001 | |
| JP | A-2001-317362 | | 11/2001 | |
| JP | A-2003-519747 | | 6/2003 | |
| JP | A-2003-519749 | | 6/2003 | |
| JP | A-2006-283629 | | 10/2006 | |
| JP | A-2007-040272 | | 2/2007 | |
| JP | A-2007-309128 | | 11/2007 | |
| WO | WO 98/57053 | A1 | 12/1998 | |
| WO | WO 01/51783 | A1 | 7/2001 | |
| WO | WO 2007/132716 | * | 11/2007 | F02B 25/22 |

OTHER PUBLICATIONS

European Search Report issued in Application No. 09 81 6099.7; Dated Nov. 15, 2011.

Japanese Office Action dated Nov. 22, 2011 issued in Japanese Patent Application No. 2010-530822 (with translation).

International Search Report issued in Application No. PCT/JP2009/066250; Dated Nov. 10, 2009 (With Translation).

Mar. 22, 2012 Office Action issued in Russian Patent Application No. RU2011116186 (with translation).

Dec. 11, 2012 Office Action issued in Japanese Patent Application No. 2012-000392; with translation.

Dec. 11, 2012 Office Action issued in Japanese Patent Application No. 2012-000393; with translation.

Dec. 21, 2012 Office Action issued in Chinese Patent Application No. 200980137626.4; with translation.

Sep. 13, 2013 European Search Report issued in European Patent Application No. 09 816 099.7.

Jun. 24, 2013 Office Action issued in Chinese Patent Application No. 200980137626.4 (with partial translation).

Dec. 24, 2013 Office Action issued in Chinese Patent Application No. 200980137626.4 (with translation).

* cited by examiner

STRATIFIED SCAVENGING TWO-STROKE ENGINE

TECHNICAL FIELD

The present invention relates to a stratified scavenging two-stroke engine. Especially, the present invention relates to an air-head stratified scavenging two-stroke engine in which pre-scavenging is performed by air.

BACKGROUND ART

Japanese Patent Application Publication No. 2001-254624 (Literature 1) discloses an air-head stratified scavenging two-stroke engine. This two-stroke engine has a piston, a cylinder in which the piston is housed so as to be able to reciprocate, a crankshaft connected to the piston via a con rod, and a crankcase in which the crankshaft is housed so as to be rotatable. This two-stroke engine also has formed therein an air-fuel mixture passage for introducing an air-fuel mixture (a mixture of fuel and air) into the crankcase, a scavenging passage that extends between a scavenging inflow port opened into the crankcase and a scavenging port opened into the cylinder, and an air passage connected to an intermediate position of the scavenging passage.

In this two-stroke engine, negative pressure that is generated in the crankcase acts on the scavenging passage through the scavenging inflow port at the time of an up stroke of the piston, whereby the air is introduced from the air passage to the scavenging passage. The air introduced to the scavenging passage is introduced into the cylinder before the air-fuel mixture at the time of a down stroke of the piston. An air layer is formed between combustion gas and the air-fuel mixture when the combustion gas is scavenged from within the cylinder. The formation of this air layer prevents blow-by of the air-fuel mixture, reducing the emission of unburned gas.

Another air-head stratified scavenging two-stroke engine is disclosed in WO98/57053 (Literature 2). In this two-stroke engine, an air passage is connected to a scavenging port by a piston at the time of the up stroke of the piston. Consequently, air fills up a scavenging passage from the scavenging port. This type of configuration can prevent an air-fuel mixture from remaining in the vicinity of the scavenging port when the air fills up the scavenging passage.

SUMMARY OF INVENTION

Technical Problem

In the conventional two-stroke engines, when filling up the scavenging passage with air, the air that enters the scavenging passage from the air passage flows through the scavenging passage toward the scavenging inflow port of the crankcase. Subsequently, the air entering the scavenging passage flows toward the scavenging port of the cylinder through the scavenging passage and is introduced to the cylinder. In other words, in the conventional two-stroke engines, the air filling up the scavenging passage needs to reverse its direction of flow when being introduced to the cylinder. In this type of configuration, however, the air-fuel mixture from the crankcase is easily mixed into the air filling up the scavenging passage. Consequently, the fuel becomes involved in the air introduced to the cylinder in advance, resulting in the emission of unburned fuel.

The present invention solves the problems described above. The present invention provides technology for reducing an amount of unburned gas emission in an air-head stratified scavenging two-stroke engine.

Solution to Technical Problem

A stratified scavenging two-stroke engine embodied in the present invention includes: a piston; a cylinder that houses the piston in a manner allowing reciprocation; a crankshaft that is connected to the piston via a con rod; a crankcase that houses the crankshaft in a manner allowing rotation; a mixture gas passage that introduces mixture gas into the crankcase; a scavenging passage that extends between a scavenging intake that opens into the crankcase and a scavenging port that opens into the cylinder; and an air passage that is connected to an intermediate position of the scavenging passage. In this engine, in a part of an upward stroke period during which the piston moves to an opposite side with respect to the crankcase, the crankcase in which negative pressure is generated is connected to the scavenging passage via the scavenging port.

For convenience sake, the present specification often expresses a direction parallel to an axis of the cylinder and extending toward the opposite side with respect to the crankcase as "upward/above," and a direction parallel to the axis of the cylinder and extending toward the crankcase as "downward/below." Therefore, a stroke in which the piston moves to the opposite side with respect to the crankcase is often expressed as "upward stroke," and a stroke in which the piston moves to the crankcase side as "downward stroke."

In the engine embodied in the present invention, at least part of air introduced to the scavenging passage can flow into the cylinder without reversing its direction of flow. The flow of the air hardly becomes disturbed in the scavenging passage, and the mixture gas can be prevented from being mixed into the air introduced to the scavenging passage. An amount of fuel that is contained in the air introduced in advance into the cylinder can be reduced significantly, and the emission of unburned fuel to the outside can be prevented.

In the scavenging passage, it is preferred that most of the air introduced from the air passage flows not toward the scavenging intake but toward the scavenging port. Accordingly, not only is it possible to prevent the flow of air from being disturbed in the scavenging passage, but also the mixture gas can be effectively prevented from being mixed into the introduced air. In this regard, the two-stroke engine preferably has at least one of the following characteristics.

First, it is preferred that, in the scavenging passage, a resistance against a flow from the intermediate position where the air passage is connected toward the scavenging port be lower than a resistance against a flow from the intermediate position where the air passage is connected toward the scavenging intake. According to this configuration, more of the air introduced from the air passage to the scavenging passage can flow toward the scavenging port with a low resistance.

Secondly, it is preferred that, in the scavenging passage, a resistance against a flow from the intermediate position where the air passage is connected toward the scavenging intake be higher than a resistance against a flow from the scavenging intake toward the intermediate position where the air passage is connected. This configuration not only can prevent the air introduced to the scavenging passage from flowing toward the scavenging intake, but also can smoothly feed, to the cylinder, the mixture gas that subsequently flows from the crankcase to the scavenging passage.

Thirdly, it is preferred that, in the scavenging passage, a position between the intermediate position where the air passage is connected and the scavenging intake be substantially closed while the crankcase in which the negative pressure is generated is connected to the scavenging passage from the scavenging port. According to this configuration, the air introduced from the air passage to the scavenging passage can smoothly flow toward the scavenging port without flowing toward the scavenging intake.

Fourth, it is preferred that, in the scavenging passage, an amount of air flowing from the intermediate position where the air passage is connected toward the scavenging intake is equal to or less than 10 percent of a total amount of air introduced from the air passage toward the scavenging passage. It has been confirmed that such a configuration not only can sufficiently prevent the flow of air from being disturbed in the scavenging passage, but also can significantly prevent the mixture gas from being mixed into the air introduced to the scavenging passage.

These characteristics described above can be embodied by various structures and thus are not limited to a specific structure. However, in the most preferred embodiment, a first check valve for inhibiting the air from flowing to the scavenging intake is provided in the section of the scavenging passage between the scavenging intake and the intermediate position where the air passage is connected. This configuration can realize a two-cycle engine comprising all of the characteristics mentioned above. In addition, almost the whole air introduced from the air passage to the scavenging passage flows toward the scavenging port without reversing its direction in the scavenging passage. As a result, an ideal stratified scavenging can be realized.

It is preferred that, in the scavenging passage, most of the air is introduced to a section between the intermediate position where the air passage is connected and the scavenging port. Thus, in the scavenging passage, the section between the intermediate position where the air passage is connected and the scavenging port is preferably longer than a section between the intermediate position where the air passage is connected and the scavenging intake of the scavenging passage. Alternatively, the section between the intermediate position where the air passage is connected and the scavenging port is preferably larger in volume than the section between the intermediate position where the air passage is connected and the scavenging intake.

Advantageous Effects of Invention

According to the two-stroke engine of the present invention, the amount of unburned gas emission can be reduced. As a result, the environmental performance of the two-stroke engine can be improved significantly.

DESCRIPTION OF EMBODIMENT

Figure 1:
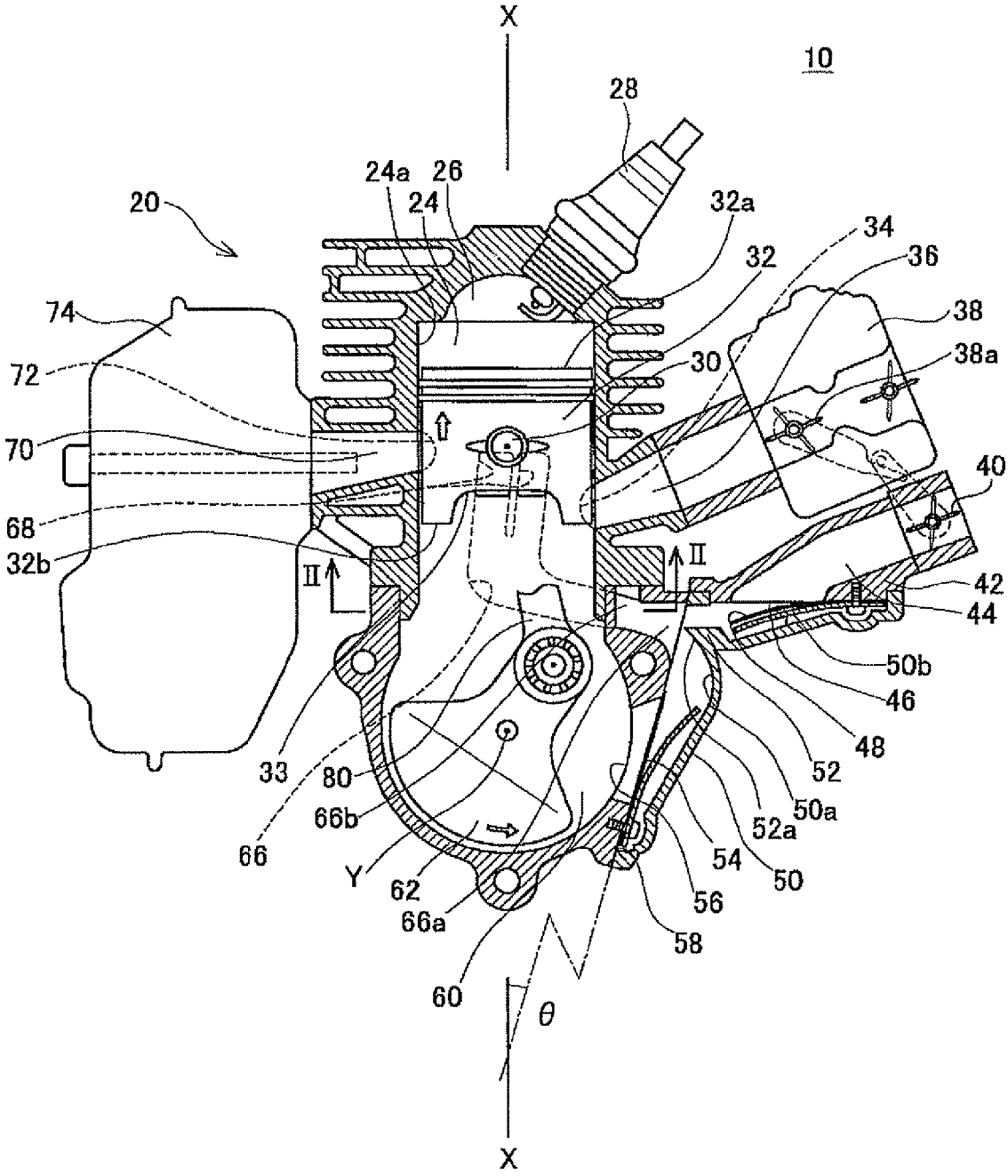
FIG. 1 is a vertical cross-sectional diagram of an engine of an embodiment.

Preferred Aspects of Embodiment (Feature 1) At least a part of a scavenging port is opened at a lower part of a piston in a part of a piston upward stroke period. As a result, a scavenging passage is connected from the scavenging port to a crankcase in which negative pressure is generated. However, the configuration of connecting the scavenging passage from the scavenging port to the crankcase in which negative pressure is generated is not limited to the above-described configuration adopted in the embodiment. For instance, a through-hole may be formed in a side surface of the piston, and the scavenging port may be communicated with the through-hole on a side surface of the piston during the part of the piston upward stroke period. Alternatively, a groove continuing into a lower end of the piston may be formed in the side surface of the piston, and the scavenging port may be communicated with the groove on the side surface of the piston during the part of the piston upward stroke period. Note that both the through-hole and the groove may be formed on the side surface of the piston.

(Feature 2) In the scavenging passage, a first reed valve is provided to a section between a scavenging intake and an intermediate position where an air passage is connected. A first reed valve, a type of a check valve, is attached in a direction that inhibits air from flowing toward the scavenging intake. Note that the first reed valve may be changed to a different type of check valve.

(Feature 3) Because the scavenging passage is provided with the first reed valve, the resistance against the flow from the intermediate position where the air passage is connected toward the scavenging port is lower than the resistance against the flow from the intermediate position where the air passage is connected toward the scavenging intake. Therefore, most of the air introduced from the air passage can flow not toward the scavenging intake but toward the scavenging port. Note that the first reed valve of the present embodiment can completely close the scavenging passage against the flow from the intermediate position where the air passage is connected toward the scavenging intake; however, the first reed valve may partially close the scavenging passage against the flow from the intermediate position where the air passage is connected toward the scavenging intake.

(Feature 4) Because the scavenging passage is provided with the first reed valve, the resistance against the flow from the intermediate position where the air passage is connected toward the scavenging intake is higher than the resistance against the flow from the scavenging intake toward the intermediate position where the air passage is connected. Therefore, not only is it possible to prevent the air introduced to the scavenging passage from flowing toward the scavenging intake, but also the mixture gas flowing subsequently from the crankcase to the scavenging passage can be fed smoothly into the cylinder. Note that the first reed valve of the present embodiment can completely inhibit the air from flowing from the intermediate position where the air passage is connected toward the scavenging intake; however the first reed valve may partially inhibit the air from flowing from the intermediate position where the air passage is connected toward the scavenging intake.

(Feature 5) Because the scavenging passage is provided with the first reed valve, the section between the intermediate position where the air passage is connected and the scavenging intake is substantially closed while the scavenging passage is connected from the scavenging port to the crankcase in which the negative pressure is generated. As a result, the air introduced from the air passage to the scavenging passage can smoothly flow toward the scavenging port without flowing toward the scavenging intake. Note that in place of the first reed valve, the engine of the present embodiment may be provided with a movable valve that opens and closes the scavenging passage in conjunction with cycles of the piston or the crankshaft. Furthermore, the scavenging intake of the scavenging passage can be closed in conjunction with the cycles of the piston or the crankshaft by providing a counterweight of the crankshaft with a valve surface to face the scavenging intake of the scavenging passage. Adjusting a range of angles forming the valve surface can substantially close the section between the intermediate position where the air passage is connected and the scavenging port while the scavenging passage is connected from the scavenging port to the crankcase in which negative pressure is generated.

(Feature 6) Because the scavenging passage is provided with the first reed valve, almost the whole air introduced from the air passage to the scavenging passage flows toward the scavenging port. As a result, an ideal stratified scavenging can be realized because the direction of the flow of the air is not reversed in the scavenging passage. However, even when most of the introduced air does not flow toward the scavenging port, the flow of the air can be prevented from being disturbed in the scavenging passage, as long as the amount of the air flowing toward the scavenging intake is equal to or less than 10 percent of the total amount of the introduced air.

(Feature 7) In an initial stage of the piston upward stroke, an upper end of the side surface of the piston facing the scavenging port is located below an upper end of the scavenging port and a lower end of the side surface of the piston facing the scavenging port is located below a lower end of the scavenging port. In other words, in an initial stage of the piston upward stroke, the scavenging port is opened above the piston, and the scavenging passage is connected to the cylinder via the scavenging port. In a middle stage of the piston upward stroke, the upper end of the side surface of the piston facing the scavenging port is located above the upper end of the scavenging port and the lower end of the side surface of the piston facing the scavenging port is located below the lower end of the scavenging port. In other words, in the middle stage of the piston upward stroke, the scavenging port is closed by the side surface of the piston. In a last stage of the piston upward stroke, the upper end of the side surface of the piston facing the scavenging port is located above the upper end of the scavenging port and the lower end of the side surface of the piston facing the scavenging port is located above the lower end of the scavenging port. In other words, in the last stage of the piston upward stroke, the scavenging port is opened below the piston, and the scavenging passage is connected to the crankcase via the scavenging port.

(Feature 8) The lower end of the side surface of the piston facing the scavenging port is provided with a cutout part. The cutout part and the scavenging port opened into the cylinder are preferably located in an orientation where an axis of the crankshaft extends with respect to an axis of the crankcase.

(Feature 9) The air passage is provided with a second check valve for inhibiting the air from flowing toward an opposite side of the scavenging passage. The second check valve can prevent the air or mixture gas from flowing backwards from the scavenging passage to the air passage. The air or mixture gas from the scavenging passage can be smoothly fed into the cylinder.

(Feature 10) A plurality of scavenging ports is provided within the cylinder. The scavenging passage diverges toward each of the scavenging ports at a section closer to the plurality of scavenging ports than the intermediate position where the air passage is connected. In other words, in the scavenging passages, the air passage is connected to a position upstream of a diverging position where the scavenging passage diverges toward the scavenging ports. According to this configuration, the air passage does not need to be connected to each of the diverging scavenging passages.

(Feature 11) The section of the scavenging passage between the scavenging intake and the intermediate position where the air passage is connected, the air passage, and the mixture gas passage are provided in the same orientation with respect to the axis of the cylinder. This configuration enables an engine to be reduced in size. In addition, making the air passage or the mixture gas passage short can reduce a flow resistance in each passage.

(Feature 12) The air passage is connected to the scavenging passage below the mixture gas passage. In other words, the air passage is provided lower than a height level of the mixture gas passage with respect to an axial direction of the cylinder, and the intermediate position of the scavenging passage where the air passage is connected is also provided lower than the height level of the mixture gas passage. Moreover, the air passage and the mixture gas passage are substantially parallel to each other. While some two-stroke engines have no space around the cylinders, most two-stroke engines have space around the crankcases. Thus, by disposing the air passage below the mixture gas passage and connecting the air passage to the scavenging passage below the mixture gas passage, dead space can be effectively utilized and the size of the engine can be reduced. Also by connecting air passage to the scavenging passage below the mixture gas passage, the section of the scavenging passage between the intermediate position where the air passage is connected and the scavenging port can be increased in length, and more of the air can be introduced to the scavenging passage.

(Feature 13) The engine has a crankcase-cover that is fixed to the crankcase and defines at least a part of the scavenging passage between the crankcase and the crankcase-cover. A flat face opposing the crankcase-cover is formed in the crankcase-cover. The flat face is parallel to the axis of the crankshaft and is at an angle within 0 to 30 degrees with respect to the axis of the cylinder. According to this configuration, a long and large-volume scavenging passage can be formed without enlarging the engine. Especially by setting the angle at approximately 30 degrees, the scavenging passage can be made long in the axial direction of the cylinder. In this case, in the scavenging passage, thick mixture gas is present in a lower section (the crankcase side) and thin fuel is present in an upper section (the cylinder side) due to a difference in weight. Since the thin fuel is introduced first to the cylinder, the amount of unburned gas emission can be reduced significantly.

(Feature 14) The flat face formed in the crankcase is provided with the first reed valve located in the scavenging passage to inhibit the air from flowing toward the scavenging intake. The flat face forms a seat surface which the first reed valve abuts onto and separates from. Because the crankcase has the flat face, the first reed valve can easily be provided on this flat face. Furthermore, the size of the first reed valve can be increased so that the flow resistance of the mixture gas can be reduced. It is beneficial to provide the first reed valve in the scavenging passage regardless of the presence of the air passage. The first reed valve provided in the scavenging passage can block both the crankcase and the scavenging passage at the time of the piston upward stroke. As a result, strong negative pressure can be generated in the crankcase (i.e., the pressure of the crankcase is lowered significantly), whereby more of the mixture gas can be introduced to the crankcase.

The first reed valve here is an example of the first check valve for inhibiting the air from flowing toward the scavenging intake. The first reed valve can be changed to a different type of check valve (preferably the one in which a flat face forms the seat surface).

(Feature 15) In the flat face formed in the crankcase, a part of the scavenging passage extending from the scavenging intake and a part of the scavenging passage extending from the scavenging port are preferably opened. In this case, the part of the scavenging passage extending from the scavenging intake and the part of the scavenging passage extending from the scavenging port are preferably connected to each other by the crankcase-cover.

(Feature 16) It is preferred that at least a part of the air passage is further formed in the crankcase-cover. In this case, a guide protrusion is formed on an inner surface of the crankcase-cover, a guide protrusion is provided at a boundary of an inner surface of the crankcase-cover facing the scavenging passage and an inner surface of the same facing the air passage. The guide protrusion has a curved face for guiding the mixture gas from the crankcase to the scavenging passage that continues to the scavenging port.

(Feature 17) It is preferred that the engine further has an air manifold that defines at least a part of the air passage between the crankcase-cover and the air manifold. In this case, the air manifold preferably has a flat face opposing an air crankcase-cover. The flat face is preferably at an angle within 80 to 130 degrees with respect to the flat face of the crankcase.

(Feature 18) It is preferred that a second check valve is disposed on the flat face of the air manifold to inhibit the air from flowing toward the opposite side of the scavenging passage. In this case, the flat face of the air manifold is preferably a seat surface which the second check valve abuts on and separates from.

Embodiment

Figure 2:
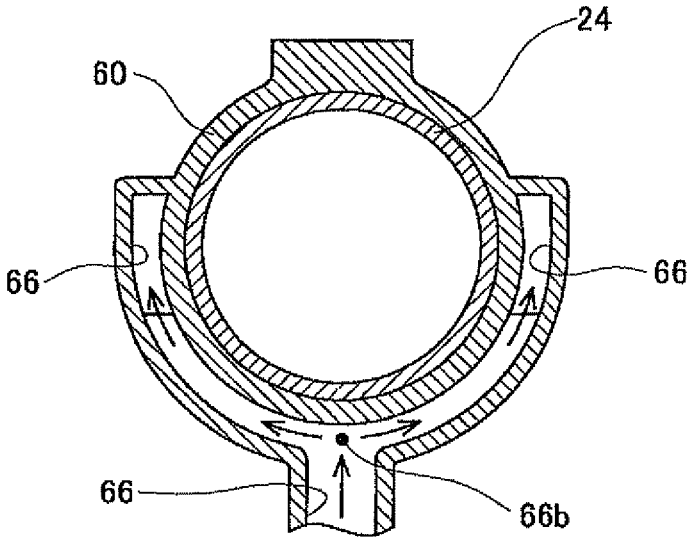
FIG. 2 is a cross-sectional diagram taken along line II-II shown in FIG. 1

Embodiments for implementing the present invention are now described with reference to the drawings. FIG. 1 is a vertical cross-sectional diagram of a stratified scavenging two-stroke engine 10 (simply referred to as "engine 10" hereinafter) of a present embodiment. FIG. 2 is a cross-sectional diagram taken along line II-II shown in FIG. 1. The engine 10 of the present embodiment is a compact, single-cylinder engine that can be mounted e.g. in power tools and operating machines.

As shown in FIG. 1, the engine 10 has an engine main body 20, a piston 32, a connecting rod 80, and a crankshaft 62. The engine main body 20 mainly has a cylinder 24, a crankcase 60, a crankcase-cover 50, and an air manifold 42. The crankcase 60 is fixed below the cylinder 24. The crankcase-cover 50 is fixed to a side part of the crankcase 60. The air manifold 42 is fixed to an upper part of the crankcase-cover 50.

The cylinder 24 houses the piston 32. The piston 32 is capable of reciprocating along an axis X of the cylinder 24. Within the cylinder 24, a combustion chamber 26 is formed above the piston 32. A spark plug 28 is disposed in the combustion chamber 26.

The crankcase 60 houses the crankshaft 62. The crankshaft 62 is supported rotatably by the crankcase 60. The piston 32 is connected to the crankshaft 62 by the connecting rod 80 and a piston pin 30. A reciprocating motion of the piston 32 within the cylinder 24 rotates the crankshaft 62 within the crankcase 60. Note that FIG. 1 omits illustration of a part of the connecting rod 80. The crankshaft 62 is an output axis of the engine 10, wherein an end part of the crankshaft 62 extends to the outside of the crankcase 60.

A mixture gas passage 36, scavenging passage 66, air passage 44, and exhaust passage 70 are formed in the engine main body 20. The mixture gas passage 36 and the exhaust passage 70 are formed in the cylinder 24. The scavenging passage 66 is configured by the crankcase 60, the crankcase-cover 50 and the cylinder 24. The air passage 44 is configured by the crankcase-cover 50 and the air manifold 42.

An inner surface 24*a* of the cylinder 24 has formed therein a suction port 34, a plurality of scavenging ports 68, and an exhaust port 72. The suction port 34, the plurality of scavenging ports 68, and the exhaust port 72 are opened/closed by the reciprocating motion of the piston 32 within the cylinder 24. The suction port 34 and the scavenging ports 68, facing each other, are formed in a direction perpendicular to an axis Y of the crankshaft 62 with respect to the axis X of the cylinder 24. The plurality of scavenging ports 68 is formed in the direction perpendicular to the axis Y of the crankshaft 62 with respect to the axis X of the cylinder 24. Note that FIG. 1 illustrates two of the scavenging ports 68; however, two more scavenging ports that are not shown are formed so as to face those two scavenging ports 68. In other words, a total of four scavenging ports are formed on the inner surface 24*a* of the cylinder 24.

The mixture gas passage 36 is connected to the suction port 34. The mixture gas passage 36 is provided with a carburetor 38 for mixing fuel into air introduced from the outside. The combustible mixture gas generated by the carburetor 38 is supplied to the suction port 34 via the mixture gas passage 36. The suction port 34 is opened below the piston 32 from a last stage of the upward stroke of the piston 32 (moving stroke toward an opposite side with respect to the crankcase 60) throughout an initial stage of the downward stroke (moving stroke toward the crankcase side 60). While the suction port 34 is opened below the piston 32, negative pressure that is generated within the crankcase 60 introduces the mixture gas from the mixture gas passage 36 into the crankcase 60.

The scavenging passage 66 is connected to the scavenging ports 68. The scavenging passage 66 extends from a scavenging intake 56 that is opened into the crankcase 60 to the scavenging ports 68 that are opened to the cylinder 24. As shown in FIGS. 1 and 2, the scavenging passage 66 diverges toward the plurality of scavenging ports 68 from a diverging position 66*b* on the passage. The scavenging ports 68 are opened above the piston 32 from a last stage of the downward stroke of the piston 32 throughout an initial stage of the upward stroke. While the scavenging ports 68 are opened above the piston 32, positive pressure that is generated within the crankcase 60 feeds the mixture gas of the crankcase 60 into the cylinder 24 via the scavenging passage 66.

The scavenging ports 68 are further opened below the piston 32 from the last stage of the upward stroke of the piston 32 throughout the initial stage of the downward stroke. While the scavenging ports 68 are opened below the piston 32, the crankcase 60 in which the negative pressure is generated is connected to the scavenging passage 66 from the scavenging ports 68. The air passage 44 for introducing the air from the outside is connected to the scavenging passage 66.

A first reed valve 54 is provided at a section of the scavenging passage 66 between the scavenging intake 56 and a connection position 66*a* of the air passage 44. The first reed valve 54, a check valve for inhibiting the air from flowing toward the scavenging intake 56, allows the air to flow only toward the scavenging ports 68. Therefore, while the scavenging ports 68 are opened below the piston 32, the air is introduced from the air passage 44 to the scavenging passage 66, and the introduced air flows toward the scavenging ports 68. As a result, the section of the scavenging passage 66 between the connection position 66*a* of the air passage 44 and the scavenging ports 68 is filled with the air. As will be described hereinafter in more detail, the air introduced to the scavenging passage 66 is introduced into the cylinder 24 in advance of the mixture gas to scavenge combustion gas (gas after combustion) of the cylinder 24. Note that the first reed valve 54 does not have to completely inhibit the air from flowing toward the scavenging intake 56, but may apply a significant resistance against the air flowing toward the scavenging intake 56. This can allow most of the air introduced to the scavenging passage 66 to flow toward the scavenging ports 68.

The exhaust passage 70 is connected to the exhaust port 72. The exhaust passage 70 is provided with a muffler 74. The exhaust port 72 is opened above the piston 32 from the last stage of the downward stroke of the piston 32 throughout the initial stage of the upward stroke of the piston 32. While the exhaust port 72 is opened above the piston 32, the combustion gas within the cylinder 24 is emitted to the exhaust passage 70 through the exhaust port 72. The emission of the combustion gas is carried out by the pressure of the combustion gas, the air flowing from the scavenging ports 68, and scavenging by using the mixture gas.

The entire configuration of the engine 10 of the present embodiment is as described above. A detailed configuration of each part of the engine 10 is described next.

The connection position 66*a* where the air passage 44 is connected to the scavenging passage 66 is provided closer to the scavenging intake 56 on the crankcase 60 side than the scavenging ports 68 on the cylinder 24 side. In other words, in the scavenging passage 66, a section between the scavenging ports 68 and the connection position 66*a* of the air passage 44 is longer than a section of the scavenging passage 66 between the scavenging intake 56 and the connection position 66*a* of the air passage 44. Additionally, the section between the scavenging ports 68 and the connection position 66*a* of the air passage 44 is larger in volume than the section of the scavenging passage 66 between the scavenging intake 56 and the connection position 66*a* of the air passage 44. Therefore, when filling up the scavenging passage 66 with the air from the air passage 44, the scavenging passage 66 can be filled with more of the air. In the engine 10 of the present embodiment, the further away the connection position 66*a* of the air passage 44 is from the scavenging ports 68, the more air can fill up the scavenging passage 66.

In the scavenging passage 66, the connection position 66*a* of the air passage 44 is provided closer to the scavenging intake 56 (the crankcase 60 side) than the diverging position 66*b* of the scavenging passage 66. In other words, the scavenging passage 66 is configured such that the air is supplied from the air passage 44 at the position upstream of the diverging position 66*b* of the scavenging passage 66. According to this configuration, the air can be supplied by the single air passage 44 to each of the diverging scavenging passages 66. By supplying the air at the position upstream of the diverging position 66*b*, it is not necessary to connect the air passage 44 to each of the diverging scavenging passages 66.

A lower end 32*b* of the piston 32 is provided with a cutout part 33 in order to reduce the weight of the piston 32 (i.e., the length of a piston skirt part is reduced). The cutout part 33 is provided in a direction parallel to the axis Y of the crankshaft 62, the direction corresponding to the direction in which the scavenging ports 68 are formed. When the position within the cylinder 24 where the scavenging ports 68 are formed corresponds to the position within the piston 32 where the cutout part 33 is formed, the scavenging ports 68 can be opened below the piston 32 without largely opening the scavenging ports 68 downward.

The air passage 44 is provided with a second reed valve 48 and an air control valve 40. The second reed valve 48, a check valve for inhibiting the air from flowing toward the opposite side of the scavenging passage 66, allows the air to flow only toward the scavenging passage 66. The second reed valve 48 can inhibit the air or mixture gas within the scavenging passage 66 from flowing backwards through the air passage 44. The air control valve 40 controls the opening of the air passage 44 to control the airflow in the air passage 44. The air control valve 40 is connected to a mixture gas control valve 38*a* of the carburetor 38 to operate in conjunction with the mixture gas control valve 38*a*.

The section of the scavenging passage 66 between the scavenging intake 56 and the connection position 66*a* of the air passage 44, the air passage 44, and the mixture gas passage 36 are provided in the same orientation with respect to the axis X of the cylinder 24. The air passage 44 and the mixture gas passage 36 are provided approximately parallel to each other. Furthermore, the air passage 44 is provided below the mixture gas passage 36 in relation to the direction parallel to the axis X of the cylinder 24 (axial direction) and connected to the scavenging passage 66 below the mixture gas passage 36. There is more space below the mixture gas passage 36 than above the mixture gas passage 36. Thus, disposing the air passage 44 below the mixture gas passage 36 and connecting the air passage 44 to the scavenging passage 66 below the mixture gas passage 36 allow the effective use of dead space, reducing the size of the engine 10. By mounting the downsized engine 10 in handheld power tools or operating machines (e.g., chainsaws, bush cutters), the operability of such power tools and operating machines can be significantly improved.

As shown in FIG. 1, a flat face 58 opposing the crankcase-cover 50 is formed in the crankcase 60. The flat face 58 of the crankcase 60 is provided parallel with respect to the axis Y of the crankshaft 62 and tilted downward to form an angle of approximately 18 degrees with respect to the axis X of the cylinder 24. An angle θ formed by the flat face 58 with respect to the axis X of the cylinder 24 is not necessarily 18 degrees. However, the angle θ formed by the flat face 58 with respect to the axis X of the cylinder 24 is preferably within 0 to 30 degrees.

On the flat face 58 of the crankcase 60, an upstream part of the scavenging passage 66 extending from the scavenging intake 56 and a downstream part of the scavenging passage 66 extending to the scavenging ports 68 are opened. The upstream part of the scavenging passage 66 extending from the scavenging intake 56 and the downstream part of the scavenging passage 66 extending to the scavenging port 68 are connected to each other by the crankcase-cover 50 opposing the flat face 58.

The first reed valve 54 described earlier is fixed to the flat face 58 of the crankcase 60. The flat face 58 of the crankcase 60 configures a seat surface which the first reed valve 54 abuts on and separates from. The first reed valve 54 closes/opens the scavenging passage 66 by abutting on or separating from the flat face 58 of the crankcase 60.

In addition to a part of the scavenging passage 66, a part of the air passage 44 is also formed in the crankcase-cover 50. A guide protrusion 52 is provided at a boundary of an inner surface 50*a* of the crankcase-cover 50 facing the scavenging passage 66 and an inner surface 50*b* of the same facing the air passage 44. The guide protrusion 52 has a guide surface 52*a* for guiding the mixture gas from the scavenging intake 56 (the crankcase 60) to the downstream part of the scavenging passage 66. The guide surface 52*a* is curved toward the downstream part of the scavenging passage 66.

A flat face 46 opposing the crankcase-cover 50 is formed in the air manifold 42. The flat face 46 of the air manifold 42 is parallel with respect to the axis Y of the crankshaft 62 and forms an angle of approximately 105 degrees with respect to the flat face 58 of the crankcase 60. Here, the angle formed by the flat face 46 of the air manifold 42 and the flat face 58 of the crankcase 60 is not necessarily 105 degrees. However, the angle formed by the two flat faces 46, 58 is preferably within 80 to 130 degrees.

The second reed valve 48 described earlier is detachably fixed to the flat face 46 of the air manifold 42. The flat face 46 of the air manifold 42 also configures a seat surface which the second reed valve 48 abuts on and separates from. The second reed valve 48 closes/opens the air passage 44 by abutting on or separating from the flat face 46 of the air manifold 42.

Next, with reference to FIGS. 3 to 7, operations of the engine 10 in one cycle are described. The engine 10, a two-stroke engine, performs one-cycle operation as the piston 32 carries out the upward stroke and the downward stroke. In FIGS. 3 to 7, black circles (●) represent the mixture gas, and white circles (○) represent the air. Crossed marks (x) represent the combustion gas.

Figure 3:
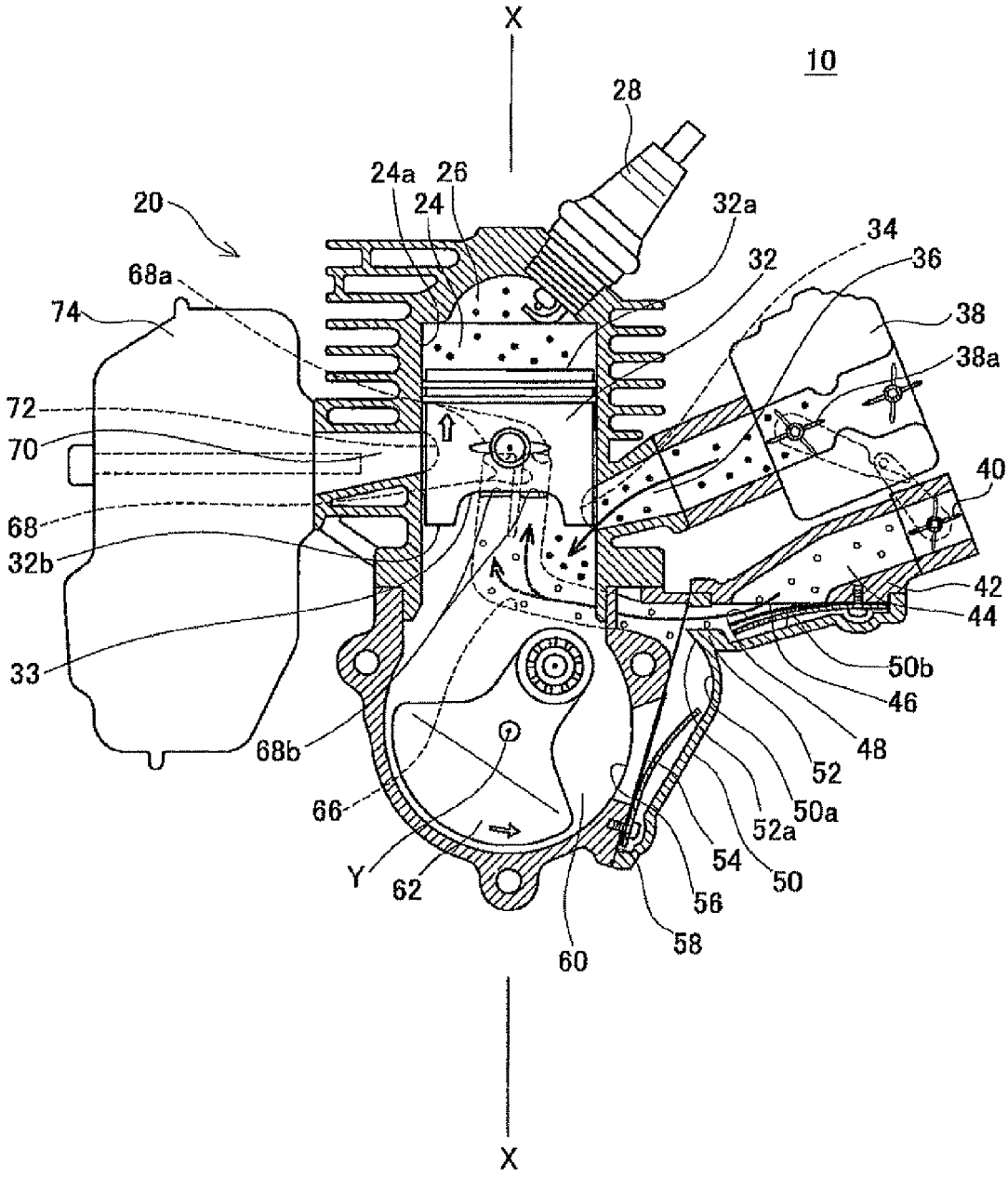
FIG. 3 is a diagram illustrating a last stage of an upward stroke of a piston.

FIG. 3 shows the last stage of the upward stroke of the piston 32. In the last stage of the upward stroke of the piston 32, the exhaust port 72 is closed by the piston 32, while the suction port 34 is opened below the piston 32. Additionally, the scavenging ports 68 are opened at the lower part of the piston 32. In other words, an upper end 32*a* on the side surface of the piston 32 that faces the scavenging ports 68 is located above an upper end 68*a* of each scavenging port 68. The lower end 32*b* on the side surface of the piston 32 that faces the scavenging ports 68 (i.e., the lower end 32*b* at the cutout part 33 of the piston 32) is positioned above a lower end 68*b* of each scavenging port 68.

In the last stage of the upward stroke of the piston 32, the mixture gas that is introduced in a previous cycle is compressed in the combustion chamber 26 located above the piston 32. On the other hand, strong negative pressure is generated within the crankcase 60 below the piston 32 due to the rising of the piston 32. Within the crankcase 60 in which the negative pressure is generated, the mixture gas passage 36 is connected through the suction port 34. As a result, the mixture gas flows from the suction port 34 into the crankcase 60 located below the piston 32.

In addition, in the last stage of the upward stroke of the piston 32, the scavenging passage 66 is connected from the scavenging ports 68 to the crankcase 60 in which the negative pressure is generated. As a result, the negative pressure within the crankcase 60 acts on the scavenging passage 66 through the scavenging ports 68, and the air flows from the air passage 44 into the scavenging passage 66. At this moment, the air introduced into the scavenging passage 66 flows through the scavenging passage 66 toward the scavenging ports 68. While the negative pressure is generated within the crankcase 60, the first reed valve 54 is closed and the scavenging passage 66 is completely closed. Therefore, the air introduced into the scavenging passage 66 is inhibited from flowing toward the scavenging intake 56. As a result, the section of the scavenging passage 66 between the connection position 66*a* of the air passage 44 and the scavenging ports 68 is filled with the air, as shown in FIG. 3.

Figure 4:
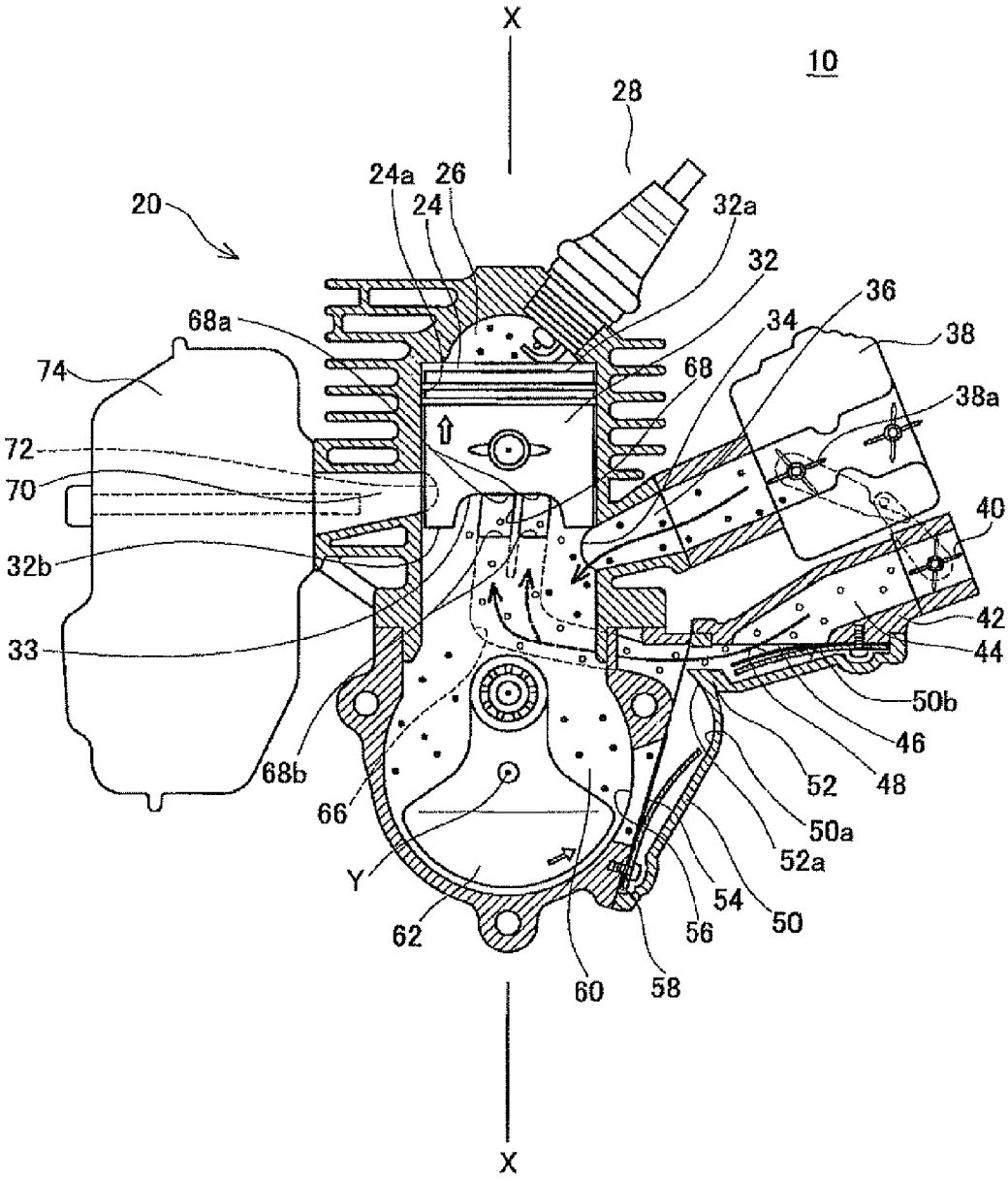
FIG. 4 is a diagram illustrating a state in which the piston is at top dead center.

Next, FIG. 4 shows a state in which the piston 32 is at top dead center. When the piston 32 is at top dead center, the exhaust port 72 is closed by the piston 32, while the suction port 34 is opened below the piston 32. The scavenging ports 68 also are opened under the piston 32. In other words, the upper end 32*a* on the side surface of the piston 32 that faces the scavenging ports 68 is located above the upper end 68*a* of each scavenging port 68, while the lower end 32*b* on the side surface of the piston 32 that faces the scavenging ports 68 is located above the lower end 68*b* of each scavenging port 68.

When the piston 32 reaches the top dead center, the compression of the mixture gas, introduction of the mixture gas into the crankcase 60, and introduction of the air into the scavenging passage 66 are almost completed. From this state, the mixture gas is ignited by the spark plug 28. The combustion gas obtained by burning the mixture gas expands rapidly and pushes the piston 32 downward. The stroke of the piston 32 then shifts to the downward stroke.

Figure 5:
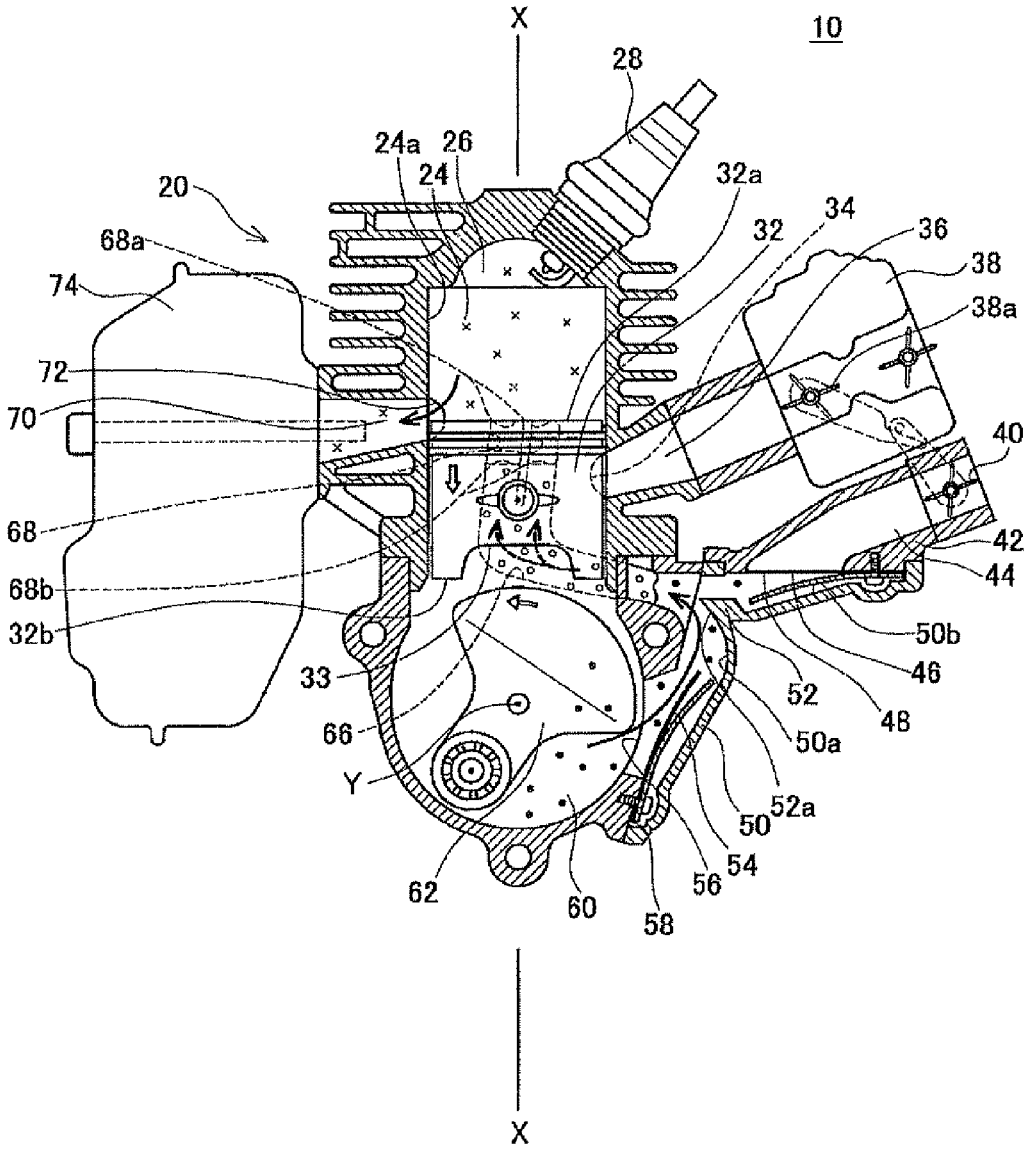
FIG. 5 is a diagram illustrating a middle stage of a downward stroke of the piston.

Next, FIG. 5 shows a middle stage of the downward stroke of the piston 32. In the middle stage of the downward stroke of the piston 32, the exhaust port 72 is opened above the piston 32, while the suction port 34 is closed by the piston 32. The scavenging port 68 also are closed by the piston 32. In other words, the upper end 32*a* on the side surface of the piston 32 that faces the scavenging ports 68 is located above the upper end 68*a* of each scavenging port 68, while the lower end 32*b* on the side surface of the piston 32 that faces the scavenging ports 68 is located below the lower end 68*b* of each scavenging port 68.

Next, FIG. 5 shows a middle stage of the downward stroke of the piston 32. In the middle stage of the downward stroke of the piston 32, the exhaust port 72 is opened above the piston 32, while the suction port 34 is closed by the piston 32. The scavenging port 68 also are closed by the piston 32. In other words, the upper end 32*a* on the side surface of the piston 32 that faces the scavenging ports 68 is located above the upper end 68*a* of each scavenging port 68, while the lower end 32*b* on the side surface of the piston 32 that faces the scavenging ports 68 is located below the lower end 68*b* of each scavenging port 68.

From the initial stage of the downward stroke of the piston 32 to the middle stage of the same, the combustion chamber 26 above the piston 32 starts emitting the combustion gas through the opened exhaust port 72. Within the crankcase 60 below the piston 32, on the other hand, positive pressure is generated as the piston 32 drops. As a result, the mixture gas within the crankcase 60 flows into the scavenging passage 66 through the scavenging intake 56. The mixture gas flowing into the scavenging passage 66 flows through the scavenging passage 66 toward the scavenging ports 68. The direction of the flow of the mixture gas within the scavenging passage 66 corresponds to the direction of the flow of the air introduced to the scavenging passage 66 in the previous stroke. Therefore, the mixture gas flowing into the scavenging passage 66 is prevented from being mixed into the air within the scavenging passage 66. As a result, in the scavenging passage 66, an air layer is formed in the scavenging ports 68, and a mixture gas layer is formed in the scavenging intake 56.

Figure 6:
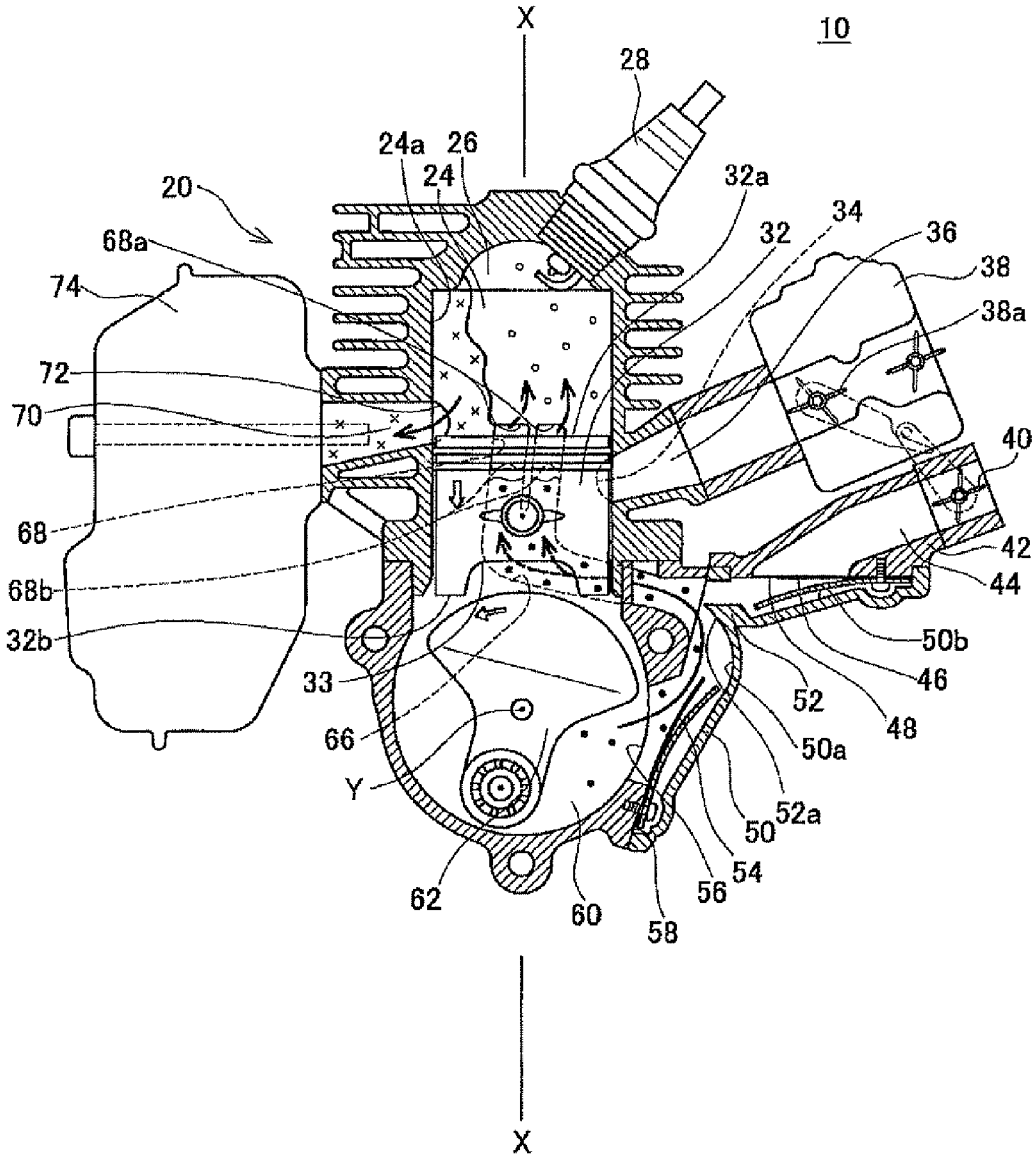
FIG. 6 is a diagram showing a last stage of the downward stroke of the piston.

Next, FIG. 6 shows the last stage of the downward stroke of the piston 32. In the last stage of the downward stroke of the piston 32, the exhaust port 72 is opened above the piston 32, while the suction port 34 is closed by the piston 32. The scavenging ports 68 also are opened above the piston 32. In other words, the upper end 32*a* on the side surface of the piston 32 that faces the scavenging ports 68 is located below the upper end 68*a* of each scavenging port 68, while the lower end 32*b* on the side surface of the piston 32 that faces the scavenging ports 68 is located below the lower end 68*b* of each scavenging port 68.

From the last stage of the downward stroke of the piston 32 to the initial stage of the upward stroke, the combustion chamber 26 above the piston 32 scavenges the combustion gas by using the air and the mixture gas filling up the scavenging passage 66. First, the air filling up the scavenging passage 66 is ejected from the scavenging ports 68 into the combustion chamber 26. Consequently, the combustion gas within the combustion chamber 26 is emitted from the opened exhaust port 72. Subsequently, the mixture gas within the scavenging passage 66 and the crankcase 60 is ejected from the scavenging ports 68 to the combustion chamber 26. As a result, the combustion gas and the air within the combustion gas 26 are ejected from the opened exhaust port 72.

Figure 7:
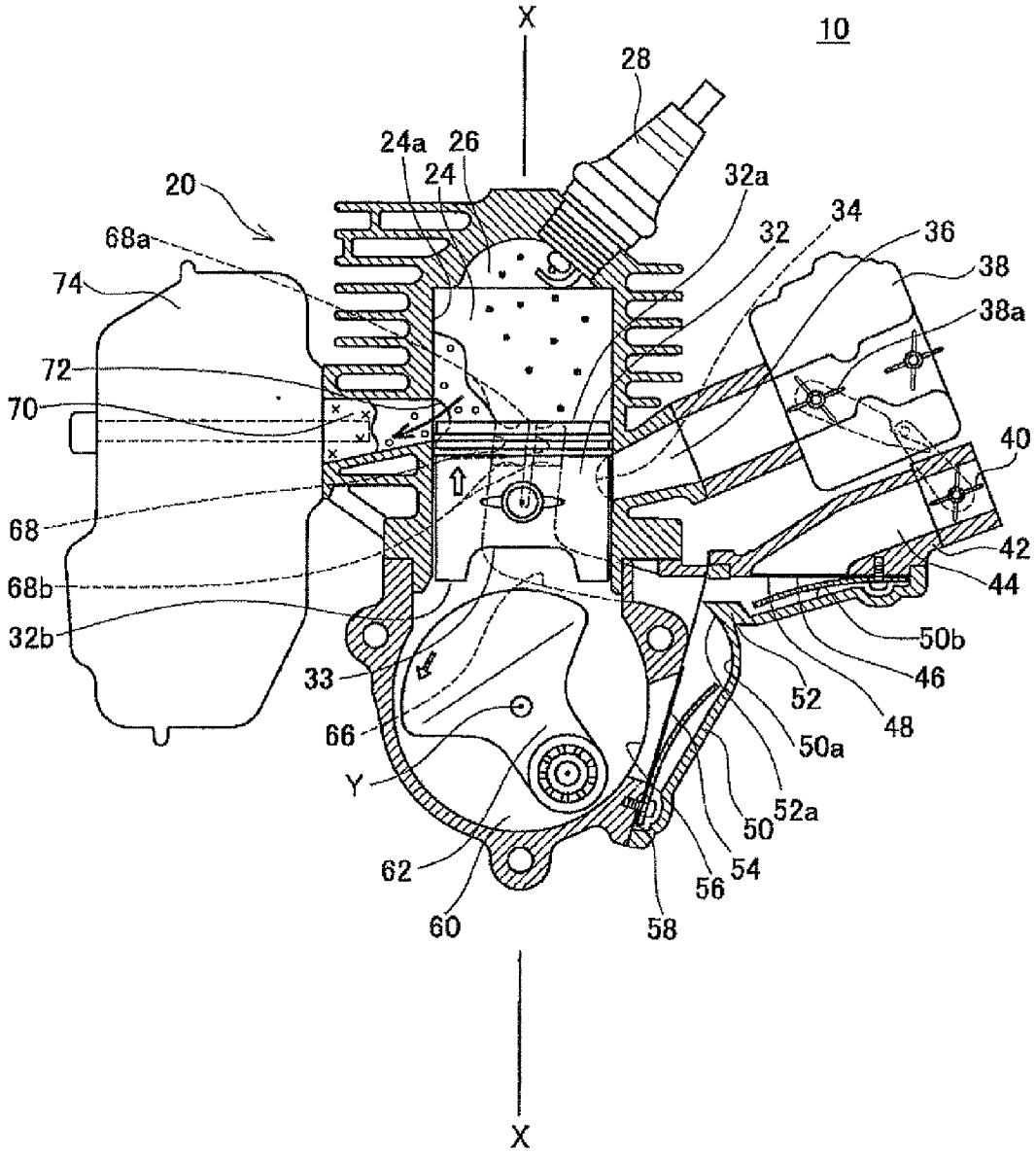
FIG. 7 is a diagram showing a middle stage of the upward stroke of the piston.

Next, FIG. 7 shows the middle stage of the upward stroke of the piston 32. In the middle stage of the downward stroke of the piston 32, the exhaust port 72 is opened above the piston 32, while the suction port 34 is closed by the piston 32. The scavenging ports 68 also are closed by the piston 32. In other words, the upper end 32*a* on the side surface of the piston 32 that faces the scavenging port 68 is located above the upper end 68*a* of each scavenging port 68, while the lower end 32*b* on the side surface of the piston 32 that faces the scavenging ports 68 is located below the lower end 68*b* of each scavenging port 68. In the middle stage of the upward stroke of the piston 32, the air remaining in the cylinder 24 is emitted from the opened exhaust port 72 as a result of the rising of the piston 32. Thereafter, the exhaust port 72 is closed by the piston 32, and the compression of the mixture gas is started.

As described above, in the engine 10 of the present embodiment, the air introduced from the air passage 44 to the scavenging passage 66 flows through the scavenging passage 66 toward the scavenging ports 68 within the cylinder 24 to fill up the scavenging passage 66. The air filling up the scavenging passage 66 then flows again toward the scavenging ports 68 and is introduced into the cylinder 24. Thus, in the engine 10 of the present embodiment, when the air filling up the scavenging passage 66 is introduced to the cylinder 24, the direction of this flow does not have to be reversed. For this reason, the air filling up the scavenging passage 66 is prevented from being mixed with the mixture gas from the crankcase 60. There is a small amount of fuel contained in the air introduced previously into the cylinder 24, and the amount of fuel that could be emitted without being burned (unburned gas) can be reduced significantly.

The above has described the embodiments of the present invention in detail, but these embodiments are merely exemplary of the present invention and not intended to limit the scope of the claims. The technologies described in the claims include a variety of examples obtained by modifying or changing the above-described embodiments.

For example, in the embodiments described above, the scavenging ports 68 are opened below the piston 32 and the crankcase 60 in which the negative pressure is generated is connected to the scavenging passage 66 from the scavenging ports 68. In this regard, a groove or hole, for example, can be formed on the piston 32, and the crankcase 60 in which the negative pressure is generated may be communicated with the scavenging ports 68 by the groove or hole formed on the piston 32.

The technical components described in the present specification or the drawings can be used independently or combined with other components to demonstrate the technical utility, and should not be limited to the combinations of the claims presented at the time of the filing of this application. The technologies illustrated in the present specification or the drawings accomplish a plurality of objectives simultaneously and provide the technical utility simply by achieving one of the objectives.

REFERENCE SIGNS LIST

10: engine
20: engine main body
24: cylinder
26: combustion chamber
32: piston
33: cutout part
34: suction port
36: mixture gas passage
42: air manifold
44: air passage
46: flat face of air manifold
48: second reed valve
50: crankcase-cover
52: guide protrusion
52*a*: guide surface of guide protrusion
54: first reed valve
56: scavenging intake
58: flat face of crankcase-cover
60: crankcase
62: crankshaft
66 scavenging passage
68: scavenging port
68*a*: upper end of scavenging port
68*b*: lower end of scavenging port
70: exhaust passage
72: exhaust port

The invention claimed is:

1. A stratified scavenging two-stroke engine comprising:

a piston;

a cylinder that houses the piston in a manner allowing reciprocation;

a crankshaft that is connected to the piston via a connecting rod;

a crankcase that houses the crankshaft in a manner allowing rotation;

a mixture gas passage that introduces mixture gas into the crankcase;

a scavenging passage that extends between a scavenging intake that opens into the crankcase and a scavenging port that opens into the cylinder;

an air passage that is connected to an intermediate position of the scavenging passage for introducing air into the scavenging passage;

a first check valve for preventing a flow of the scavenging passage toward the scavenging intake, wherein the first check valve is disposed within a section of the scavenging passage between the scavenging intake and the intermediate position where the air passage is connected; and a crankcase-cover that is fixed to the crankcase and defines at least a part of the scavenging passage between the crankcase and itself, wherein the crankcase comprises a flat face contacting the crankcase-cover, wherein the flat face is parallel to an axis of rotation of the crankshaft, and is tilted downward to form an angle within 0 to 30 degrees with, respect to a longitudinal axis of the cylinder, and wherein, in a part of an upward stroke period during which the piston moves to an opposite side with respect to the crankcase, the crankcase in which negative pressure is generated connects to the scavenging passage via the scavenging port.

2. The stratified scavenging two-stroke engine as in claim 1, wherein, in the scavenging passage, a resistance against a flow from the intermediate position where the air passage is connected toward the scavenging port is lower than a resistance against a flow from the intermediate position where the air passage is connected toward the scavenging intake.

3. The stratified scavenging two-stroke engine as in claim 1, wherein, in the scavenging passage, a resistance against a flow from the intermediate position where the air passage is connected toward the scavenging intake is higher than a resistance against a flow from the scavenging intake toward the intermediate position where the air passage is connected.

4. The stratified scavenging two-stroke engine as in claim 1, wherein, in the scavenging passage, a position between the intermediate position where the air passage is connected and the scavenging intake is substantially closed while the crankcase in which the negative pressure is generated is connected to the scavenging passage from the scavenging port.

5. The stratified scavenging two-stroke engine as in claim 1, wherein, in the scavenging passage, an amount of air flowing from the intermediate position where the air passage is connected toward the scavenging intake is equal to or less than 10 percent of a total amount of air introduced from the air passage into the scavenging passage.

6. The stratified scavenging two-stroke engine as in claim 1, wherein a section of scavenging passage between the intermediate position where the air passage is connected and the scavenging port is longer than a section between the intermediate position where the air passage is connected and the scavenging intake.

7. The stratified scavenging two-stroke engine as in claim 1, wherein a section of scavenging passage between the intermediate position where the air passage is connected and the scavenging port is larger in volume than a section between the intermediate position where the air passage is connected and the scavenging intake.

8. The stratified scavenging two-stroke engine as in claim 1, further comprising a plurality of scavenging ports that is formed within the cylinder, wherein the scavenging passage diverges toward each scavenging port at a position between the intermediate position where the air passage is connected and the plurality of scavenging ports.

9. The stratified scavenging two-stroke engine as in claim 1, wherein a section of the scavenging passage between the scavenging intake and the intermediate position where the air passage is connected, the air passage, and the mixture gas passage are arranged in a substantially same direction with respect to a longitudinal axis of the cylinder.

10. The stratified scavenging two-stroke engine as in claim 1, wherein, with respect to a longitudinal direction of the cylinder, the intermediate position where the air passage is connected is located lower than a height level of the mixture gas passage.

11. The stratified scavenging two-stroke engine as in claim 1, wherein the first check valve is disposed on the flat face of the crankcase.

12. The stratified scavenging two-stroke engine as in claim 1, wherein a part of the scavenging passage extending from the scavenging intake and a part of the scavenging passage extending from the scavenging port respectively open at the flat face of the crankcase.

13. The stratified scavenging two-stroke engine as in claim 1, wherein at least a part of the air passage is formed within the crankcase-cover, a guide protrusion is formed on an inner surface of the crankcase-cover, the guide protrusion is located at a boundary of a part of the inner surface facing the scavenging passage and a part of the inner surface facing the air passage, and the guide protrusion comprises a curved face for guiding the mixture gas from the crankcase to the scavenging passage that connects to the scavenging port.

14. The stratified scavenging two-stroke engine as in claim 1, further comprising an air manifold that is fixed to the crankcase-cover and defines at least a part of the air passage between the crankcase-cover and the air manifold, wherein the air manifold comprises a flat face contacting the crankcase-cover, and the flat face of the air manifold is at an angle within 80 to 130 degrees with respect to the flat face of the crankcase with which the crankcase-cover contacts.

15. The stratified scavenging two-stroke engine as in claim 14, further comprising a second check valve disposed on the flat face of the air manifold, the second check valve being located within the air passage for inhibiting a flow in the air passage toward an opposite side of the scavenging passage.

16. The stratified scavenging two-stroke engine as in claim 1, further comprising a second check valve located within the air passage, the second check valve inhibiting a flow in the air passage toward an opposite side of the scavenging passage.

17. A stratified scavenging two-stroke engine comprising:

a piston;

a cylinder that is houses the piston in a manner allowing reciprocation in a vertical direction;

a crankshaft located below the piston that is connected to the piston via a connecting rod;

a crankcase that houses the crankshaft in a manner allowing rotation;

a mixture gas passage that introduces mixture gas into the crankcase;

a scavenging passage that extends between a scavenging intake that opens into the crankcase and a scavenging port that opens into the cylinder; and a crankcase-cover that is fixed to the crankcase and defining at least a part of the scavenging passage between the crankcase and itself, wherein the crankcase comprises a flat face opposing the crankcase-cover, and the flat face of the crankcase is parallel to an axis of rotation of the crankshaft and is tilted downward to form an angle within 0 to 30 degrees with respect to a longitudinal axis of the cylinder.

18. The stratified scavenging two-stroke engine as in claim 17, further comprising an air passage that introduces air into the scavenging passage.

* * * * *